US005740692A

United States Patent [19]

Dunwoody

[11] Patent Number: 5,740,692

[45] Date of Patent: Apr. 21, 1998

[54] CONTAINERS

[75] Inventor: Paul Robert Dunwoody, Wantage, United Kingdom

[73] Assignee: Carnaudmetalbox (Holdings) USA, Inc., Wilmington, Del.

[21] Appl. No.: 643,248

[22] Filed: May 2, 1996

[30] Foreign Application Priority Data

May 26, 1995 [GB] United Kingdom ..... 9510572

[51] Int. Cl.[6] ..... B21D 22/00; B21D 22/21; B21B 25/00

[52] U.S. Cl. ..... 72/347; 72/465

[58] Field of Search ..... 72/347, 349, 285, 72/465, 348

[56] References Cited

U.S. PATENT DOCUMENTS

| | | | |
|---|---|---|---|
| 3,258,948 | 7/1966 | Carlson, Sr. | 72/465 |
| 3,745,804 | 7/1973 | Langewis et al. | 72/349 |
| 4,051,707 | 10/1977 | Valek et al. | 72/348 |
| 4,195,510 | 4/1980 | Juergens | 72/350 |
| 4,554,815 | 11/1985 | Weishalla | 72/349 |
| 4,627,258 | 12/1986 | Loges et al. | 72/465 |
| 4,818,210 | 4/1989 | Van Dijk et al. | 72/465 |

FOREIGN PATENT DOCUMENTS

| | | |
|---|---|---|
| 0005084 | 4/1979 | European Pat. Off. . |
| 56-209437 | 12/1981 | Japan . |

OTHER PUBLICATIONS

Search Report dated Nov. 6, 1995.

Search Report dated Jul. 24, 1995.

*Primary Examiner*—Lowell A. Larson
*Assistant Examiner*—R. A. Butler
*Attorney, Agent, or Firm*—Diller, Ramik & Wight, PC

[57] ABSTRACT

An apparatus, for forming a container body from a sheet metal component, comprises a punch 31, an annular die 10, axially aligned with the punch, and an annular blankholder 32 surrounding the punch so arranged that relative motion as between the blankholder 32 and an end face 12 of the die restrains the periphery of the sheet metal component as the punch enters the annular die; the die 10 has a spherical bearing surface 17 centered on the longitudinal punch axis, and a die holder 20 has an arcuate surface 22 to co-operate with the spherical surface 17 of the die to impose a restraining force on sheet metal between the die face 12 and the blankholder, 32.

11 Claims, 2 Drawing Sheets

CONTAINERS

BACKGROUND OF THE INVENTION

This invention relates to the drawing of sheet metal into hollow articles such as can bodies, and more particularly but not exclusively, to the re-drawing of a drawn metal cup into a deeper can of reduced diameter.

Known apparatus for drawing or deep drawing comprises a punch, an annular die held in axial alignment with the punch, and a blank-holder sleeve surrounding the punch and movable towards and away from a face of the annular die to the periphery of a blank or cup while relative motion as between the punch and die draws the blank or cup into the annular die.

European Patent No 0005084 describes a punch, die and blank-holder assembly in which the blank-holder sleeve is mounted on a spherical bearing to accommodate any tilting necessary to equalise pressure around the base of the cup as the punch enters the die. Centring springs are arranged around the blank-holder to resiliently urge it to concentricity with the punch. A problem arising with this floating blank-holder is that when mounted in a horizontal press the free end of the blank-holder tends to droop to a mal-aligned position before applying pressure to the blank.

In contrast this invention provides apparatus for forming a container body from a sheet metal component, said apparatus comprising a punch, an annular die axially aligned with the punch, and an annular blank-holder surrounding the punch so arranged that relative motion as between the blank-holder and an end face of the die restrains the periphery of a blank or cup as the punch enters the annular die, characterised in that, the die has a spherical bearing surface portion centred on the longitudinal punch axis, and a die holder having an annular surface of arcuate cross section to co-operate with the spherical surface of the die to impose a restraining force on sheet metal between the die face and the blank-holder.

In one embodiment the restraining means is a draw die insert, used for forming a cup shaped article of thin material of a larger diameter into a can body of smaller diameter; a holder for the draw die insert, and a clamping sleeve positionable inside the cup shaped article, wherein that the draw die insert has a spherical surface positioned against a mating arcuate surface in the holder, with the centre of the spherical surface positioned at a point on the axis of and close to the centre of the surface of the draw die insert which forms the can body, such that the draw die insert is free to tilt allowing force applied by the clamping sleeve to be reacted against evenly around the cup shaped article by the draw die insert.

It is preferable that passages in the holder are present to permit flow of pressurised fluid to the spherical bearing surfaces.

The die may be of a shape to clamp a non round blank or cup.

SUMMARY OF THE INVENTION

Tilting movement of the die in the spherical bearing may be limited.

The movement of die towards the clamping means may also be limited.

The clamping pad or blankholder and die or die insert may have draw beads to enhance the clamping force.

Advantages of allowing the die to tilt are:

1. Inertia forces on the die are minimised because the weight of the die is fully supported in the tool-pack.

2. Location of the tiltable die avoids the problem of droop when a blank-holder is mounted for motion along a horizontal axis in a press.

3. Movement of a tiltable die may be limited on one side by an annular retaining ring while pressurised lubricant, preferably delivered from the tool-pack, may be used to thrust the die against the retaining plate until such time that a punch entering the die causes the orientation of the die to alter.

Various embodiments will now be described by way of example and with reference to the accompanying drawings in which,

DESCRIPTION OF THE PREFERRED EMBODIMENTS

Figure 1:
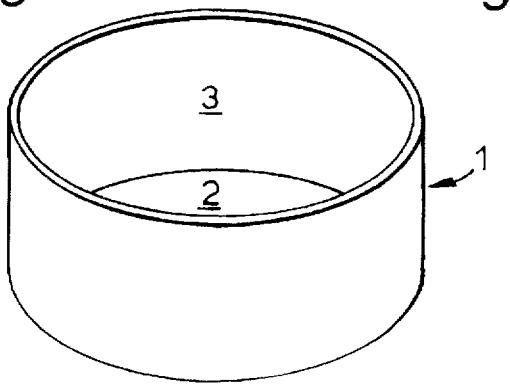
FIG. 1 is a perspective view of a round, drawn cup.

FIG. 1 shows a cup 1 drawn from sheet metal to comprise a bottom wall 2 and a cylindrical side wall 3 upstanding from the periphery of the bottom wall.

Figure 1A:
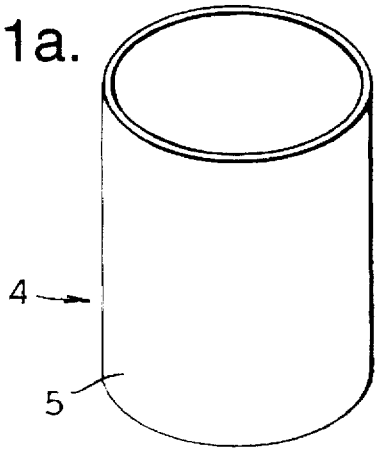
FIG. 1*a* is a perspective view of a cup re-drawn from the cup of FIG. 1.

FIG. 1*a* shows a re-drawn cup 4 made by entering a blankholder and punch into the cup of FIG. 1*a* and pressing the punch into a die to make a re-drawn cup comprising an end wall (not visible in FIG. 1*a*) and a cylindrical side wall 5 of reduced diameter, and increased height, upstanding from the periphery of the end wall.

Figure 2:
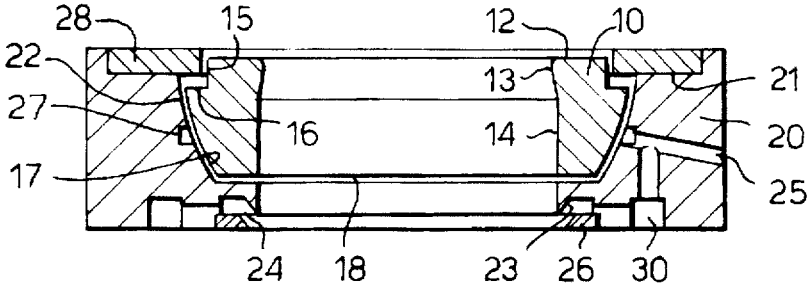
FIG. 2 is a side view, sectioned on a diameter, of a re-draw die according to the invention.
Figure 3:
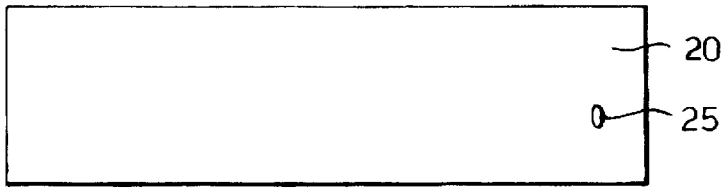
FIG. 3 is a side view of the die holder of FIG. 2.

FIG. 2 shows a die 10 and die holder 20 suitable for re-drawing the cup 1 shown in FIG. 1 into the redrawn cup 4 shown in FIG. 1*a*. The die 10 comprises a flat annular surface 12 defining the entry to a die radius 13 and throat 14. The outer periphery of the die 10 includes a cylindrical wall 15 depending from the periphery of the surface 12, a ledge 16 extending outwardly from the cylindrical wall 15, a spherical surface portion 17 extending downwards from and inwards from the ledge 16, to terminate at a flat bottom surface 18.

The die holder 20 comprises a recessed annular face 21, an annular bearing surface 22 of arcuate cross-section depending from the interior of the face 21 and an orifice 23 defining the top of a swirl chamber 24 which will be described later with reference to FIG. 4. The outer wall of the die holder is round and includes an aperture 25 for entry of lubricating fluid. A groove 27 distributes evenly pressurised fluid around the die between the spherical surface portion 17 and the annular bearing surface 22, the die 10 is retained in the holder 20 by a cover plate 28 so that the cylindrical wall is thrust centrally into the cover plate 28 by pressurised fluid until an advancing cup, on a punch, overcomes the fluid pressure and the die tilts to impose a substantially equal pressure all around the cup during re-drawing.

Figure 4:
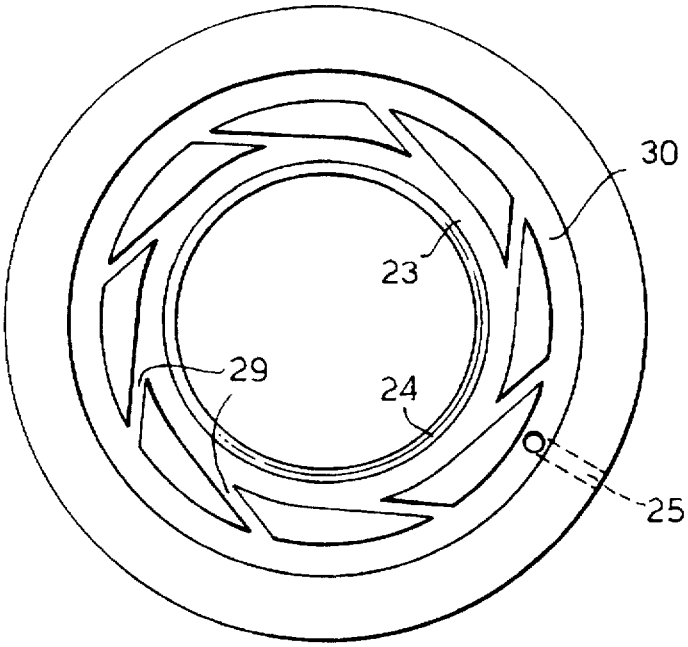
FIG. 4 is an underplan view of the die-holder shown in FIG. 3.

Referring to FIGS. 2 and 4 it will be understood that the annular swirl chamber 24 is fed from tangential channels 29 receiving fluid from an annular distribution channel 30 which is fed from a radial passage way having entry 25. A lip on the orifice plate 23 co-operates with a chamfer on an annular plate 26 to direct swirling lubricant forward towards a further die. As shown in FIG. 2, the same fluid used to lubricate a further die is also used to support the die 10 in readiness for any tilting required. However, if desired, the die may be supported by a separate source of pressurised fluid.

Figure 5:
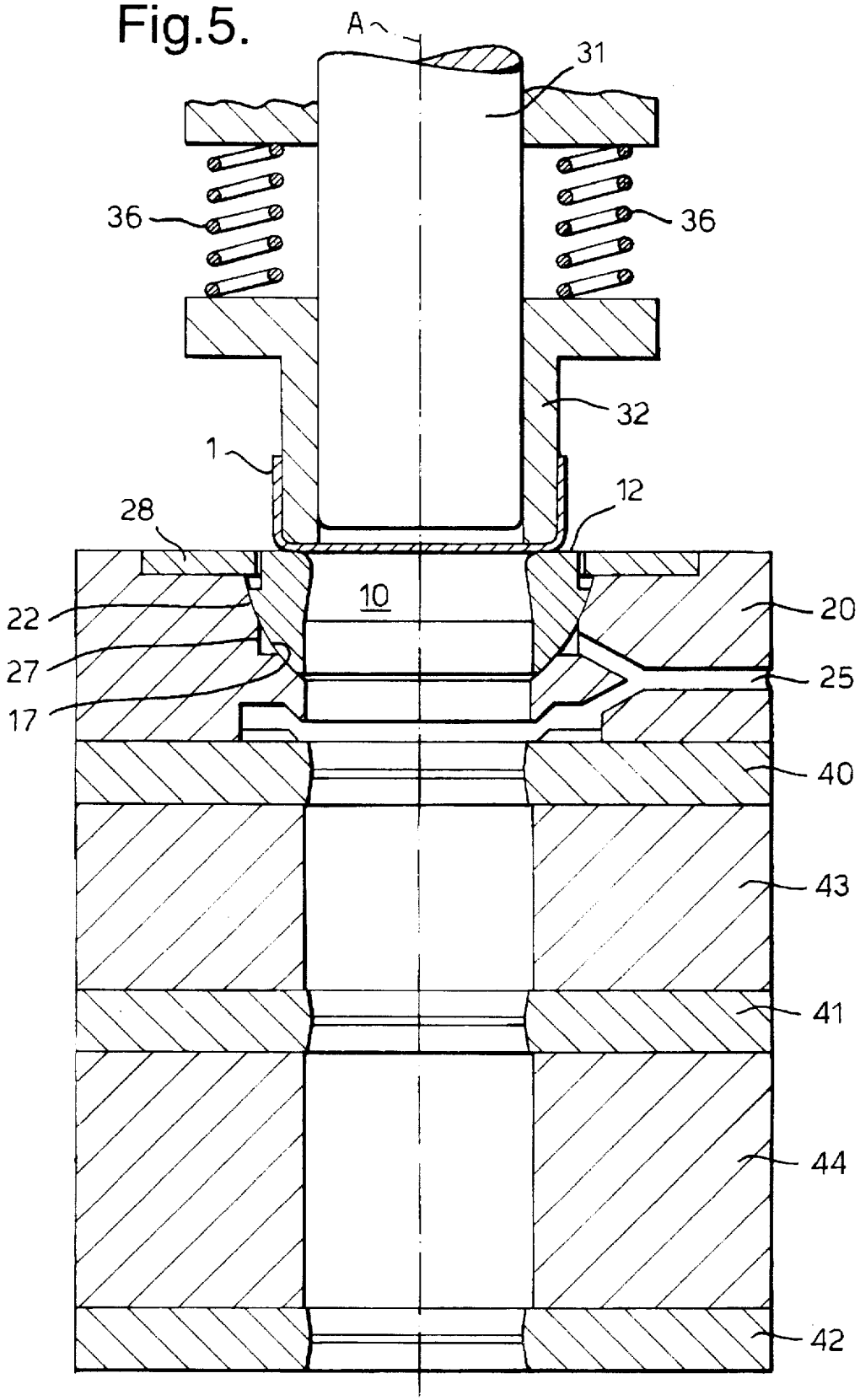
FIG. 5 is a diagrmmatic representation of a punch, blank-holder, re-draw die and wall ironing dies in a tool-pack.

FIG. 5 shows apparatus for re-drawing a cup to a can body of lesser diameter than the cup. The apparatus comprises a punch 31 moveable to and fro along an axis A, a blankholder sleeve 32 surrounding the punch 31, an annular die 10 axially aligned with the punch 31 and blankholder 32 and a first die holder 20 having an annular bearing surface 22 of arcuate cross section to support a spherical surface portion 17 of the die. The die 10 is held in the spherical bearing surfaces by a cover plate 28 against which the die is thrust by fluid pressure introduced through a groove 27 fed from an entry aperture 25 via a passage way through the die holder as described above. The swirl chamber 24 shown in FIGS. 2 and 4 has been omitted for clarity in FIG. 5 but is preferably present to lubricate a further die.

The blankholder 32 is moveable towards and away from the die 10 to bring a cup 1 to the die and press the bottom 2 of the cup against the flat face of the die 10 while the punch 31 pushes the cup into the die. The blankholder sleeve is moved by a second action of a press (not shown) acting through an array of springs 33, or similar resilient device.

FIG. 5 shows the apparatus at a time when the bottom 2 of a cup 1 on the blankholder sleeve 32 has been pressed against the flat surface 12 of the die 10 by pressure developed in springs 33. The punch 31 is about to continue motion along axis A to push the bottom of the cup into the die 10.

As the blankholder sleeve 32 pushes the bottom of the cup 1 against the flat surface 12 of the die, the die is able to tilt as necessary to impose equal blank holding pressure to a margin all around the bottom 2 of the cup 1 so that the motion of punch 31 into the die forms a redrawn cup of substantially equal wall thickness and height around the cylindrical side wall 5 shown in FIG. 1*a*.

Blankholding pressure between the sleeve 32 and die face 12 causes the spherical surface portion 17 of the die to move onto the annular bearing surface 22 of the holder so stopping fluid flow from groove 27 so that more fluid is diverted to the swirl chamber 24 to lubricate another die.

FIG. 5 shows a further die in the form of a wall ironing die 40 and two further ironing rings 41, 42 which are conventional in not having the ability to tilt. Rings 40, 41 and 42 are held apart by spacers 43, 44.

Although a preferred embodiment of the invention has been specifically illustrated and described herein, it is to be understood that minor variations may be made in the apparatus without departing from the spirit and scope of the invention, as defined the appended claims.

I claim:

1. Apparatus for forming a container body from a sheet metal component, said apparatus comprising a punch, an annular die axially aligned with the punch, and an annular blankholder surrounding the punch so arranged that relative motion as between the blankholder and an end face of the die restrains a periphery of the sheet metal component as the punch enters the annular die, characterised in that, the annular die has a spherical bearing surface portion centred on an effecting tilting movement relative to the longitudinal punch axis, and a die holder having an annular surface of arcuate cross-section cooperative with the spherical bearing surface portion of the annular die to impose a restraining force on sheet metal between the die end face and the blankholder.

2. Apparatus according to claim 1 wherein the die holder has passages to permit flow of pressurised fluid to the spherical bearing surfaces.

3. Apparatus according to claim 1 wherein the annular blank holder is of a shape to restrain a non-round sheet metal component.

4. Apparatus according to claim 1 wherein tilting movement of the die is limited by an annular plate of the holder.

5. The apparatus as defined in claim 1 wherein said annular die spherical bearing surface portion and said die holder annular arcuate surface are in sliding contact with each other.

6. The apparatus as defined in claim 1 wherein said annular die spherical bearing surface portion is substantially convexly curved relative to said longitudinal punch axis and said die holder annular arcuate surface is substantially concavely curved relative to said longitudinal punch axis.

7. The apparatus as defined in claim 1 wherein said annular die spherical bearing surface portion and said die holder annular arcuate surface are in sliding contact with each other, said annular die spherical bearing surface portion being substantially convexly curved relative to said longitudinal punch axis, and said die holder annular arcuate surface being substantially concavely curved relative to said longitudinal punch axis.

8. The apparatus as defined in claim 1 including stop means for limiting the tilting movement of the annular die relative to the die holder.

9. The apparatus as defined in claim 5 including stop means for limiting the tilting movement of the annular die relative to the die holder.

10. The apparatus as defined in claim 6 including stop means for limiting the tilting movement of the annular die relative to the die holder.

11. The apparatus as defined in claim 7 including stop means for limiting the tilting movement of the annular die relative to the die holder.

* * * * *